US011365749B2

(12) United States Patent
Haegele et al.

(10) Patent No.: US 11,365,749 B2
(45) Date of Patent: Jun. 21, 2022

(54) FAN WHEEL DRIVEN IN ONLY ONE ROTATIONAL DIRECTION

(71) Applicant: IE ASSETS GMBH & CO. KG, Schorndorf (DE)

(72) Inventors: Karl Haegele, Schorndorf (DE); Markus Lechler, Schorndorf (DE)

(73) Assignee: IE ASSETS GMBH & CO. KG, Schorndorf (DE)

( * ) Notice: Subject to any disclaimer, the term of this patent is extended or adjusted under 35 U.S.C. 154(b) by 134 days.

(21) Appl. No.: 17/025,284

(22) Filed: Sep. 18, 2020

(65) Prior Publication Data

US 2021/0003141 A1 Jan. 7, 2021

Related U.S. Application Data

(63) Continuation-in-part of application No. PCT/DE2019/100234, filed on Mar. 15, 2019.

(30) Foreign Application Priority Data

Mar. 20, 2018 (DE) ..... 10 2018 106 455.1

(51) Int. Cl.
*F04D 29/36* (2006.01)

(52) U.S. Cl.
CPC ..... *F04D 29/362* (2013.01)

(58) Field of Classification Search
CPC ..... F04D 29/362; F04D 29/329
See application file for complete search history.

(56) References Cited

U.S. PATENT DOCUMENTS 3,054,458 A * 9/1962 Marsico ..... F04D 29/362 416/157 R
4,919,623 A * 4/1990 Billman ..... G01R 1/0433 439/70
6,592,328 B1 * 7/2003 Cahill ..... F04D 29/362 416/214 R
2012/0240878 A1 9/2012 Hagele

FOREIGN PATENT DOCUMENTS

DE 10 2004 035 631 A1 2/2006
JP 5820995 A 2/1983

OTHER PUBLICATIONS

International Search Report for the corresponding international application No. PCT/DE2019/100234 in the German language dated Jun. 12, 2019, 3 pages.
English translation of the International Search Report for the corresponding international application No. PCT/DE2019/100234 dated Jun. 12, 2019, 3 pages.

* cited by examiner

*Primary Examiner* — Sabbir Hasan
(74) *Attorney, Agent, or Firm* — Ronald S. Lombard

(57) ABSTRACT

A fan wheel to be driven in only one rotational direction comprising a central drive unit. A hub positioned coaxially relative to the drive unit and comprising radial fan blades mounted in the hub. The fan blades engage at the base end of the hub between two drive tracks which are fixed relative to the drive unit and are arranged coaxially opposite one another in the direction of the axis of rotation of the fan wheel. The fan blades can be adjusted in terms of their blade angle, into opposing blowing directions, by being driven by a respective one of the drive tracks about their blade axis via a reversal plane which extends perpendicular to the plane of rotation of the fan wheel.

10 Claims, 4 Drawing Sheets

3
27
20
21
16
15
1
22
19
23
32
21
18
20
17
6
29
7
2
10
12
24
4
9
28
8
35

FAN WHEEL DRIVEN IN ONLY ONE ROTATIONAL DIRECTION

CROSS-REFERENCE TO RELATED APPLICATIONS

This is a continuation-in-part application of pending international patent application PCT/DE2019/100234 filed Mar. 15, 2019 and claiming the priority of German patent application No. 10 2018 106 455.1 filed Mar. 20, 2018. Both the said international patent application PCT/DE2019/100234 and the said German patent application No. 10 2018 106 455.1 are incorporated herein by reference in their entireties as though fully set forth. Reference is also made to co-pending U.S. patent application Ser. No. 17/121,960 filed Dec. 15, 2020, by the present applicant, IE ASSETS GMBH & CO. KG, for an invention, entitled "Fan Wheel Driven In Only One Rotational Direction".

BACKGROUND OF THE INVENTION

The invention concerns a fan wheel which is driven in only one rotational direction so that the associated drive unit does not need to be operable in opposite rotational directions for blowing in opposite directions and can also change the blowing volume in particular depending on an axial load on the fan wheel and wherein the axial load of the fan wheel is adjustable as necessary.

DESCRIPTION OF PRIOR ART

U.S. Pat. No. 3,054,458 issued Sep. 18, 1962 to Corrodo Marsico discloses a fan wheel which is driven for rotation as a unit and to this end is connected to and supported by its hub for driving the fan wheel. The hub of the fan wheel is provided at its circumference with radially projecting fan blades. The fan blades are provided at their foot ends with pinions which are disposed between two permanently engaged axially spaced drive paths which extend parallel to the rotational plane of the fan wheel for the transmission of torque. The drive paths which are coupled to each other via the pinions are rotatably adjustable around the hub axis by an adjustment drive which is accommodated in the hub. In this way also the blade angle of the fan blade is adjustable via the pinion to a desired blow volume in each case in accordance with the particular rotation of the drive.

SUMMARY OF THE INVENTION

A fan wheel to be driven in only one rotational direction comprising a central drive unit. A hub positioned coaxially relative to the drive unit and comprising radial fan blades mounted in the hub. The fan blades engage at the base end of the hub between two drive tracks which are fixed relative to the drive unit and are arranged coaxially opposite one another in the direction of the axis of rotation of the fan wheel. The fan blades can be adjusted in terms of their blade angle, into opposing blowing directions, by being driven by a respective one of the drive tracks about their blade axis via a reversal plane which extends perpendicular to the plane of rotation of the fan wheel.

This is achieved by design features of the fan wheel which extends to coaxially with the drive unit of the fan wheel and which surrounds and/or accommodates at least part of the drive unit and is driven with some limited axial and rotational play relative to a hub driven by the drive unit. In this hub, the radial fan blades are supported so as to be rotatable about their longitudinal axes which are propped up with respect to, and are synchronously driven by, the drive unit in axially spaced drive passages in accordance with the load-dependent axial adjustment of the hub with respect to the drive unit. The rotational play of the hub with respect to the drive unit and, accordingly, the adjustment of the fan blades supported on the hub in their orientation to the plane of rotation of the fan wheel is limited to a shift or switch window, if appropriate, in a damping way and/or a temperature-dependent manner. This occurs in such a way that, with respect to a reversal plane which includes the axes of rotation of the fan blades, the fan blades are rotatable about their axes of rotation for blowing in opposite conveying directions, that is a suction or blowing direction.

For the drive connection of the hub to the drive unit with limited rotational play in accordance with the invention an adjustment drive is provided in the axial connection between the drive unit and the hub head, wherein a star wheel is connected to the hub head for rotation therewith and to be axially movable in accordance with the axial play between the hub and the drive unit.

The star wheel is disposed in the axial overlap area of the two annular discs which are connected to the drive unit, in particular to a drive part of the drive unit, in a rotational and position-fixed manner and, with respect to which the star wheel is axially displaceable within the range of the provided axial play of the hub with respect to the drive part. These annular discs are interconnected not only in a stable manner but, preferably, are provided at their inner circumference each with the same meander-shaped structures with respect to which oppositely meander-shaped structures are provided at the star wheel circumference.

By an interaction of the meander shaped, in particular, congruent structures of the annular discs and the meander-shaped circumferential structures of the star wheel in the circumferential direction radial engagement areas (shift windows) are provided which permit and limit a rotation of the star wheel with respect to the annular disc in accordance with a—in circumferential direction—rotational displacement between the annular disc-side and the star wheel-side and which provide in this way in each case respective shift windows which are to be reached by the axial displacement of the star wheel at the same time.

Depending on the respective shift window size and the predetermined relative rotatability between the hub and the drive unit, the reversal procedure in the switch-over from blowing to suction or vice versa and consequently also the axial load of the fan wheel dependent on the change in the air volume and the blow direction which is limited to a relatively small rotational range sufficient to facilitate an essentially free axial transfer of the star wheel so that it can be moved easily by only a small force from a plane position provided by one of the annular discs to the plane of the other annular disc.

Accordingly, the reversal procedure does not require large adjustment forces since the rotation of the fan blades about their axes of rotation occurring with the reversal is enhanced in sudden reversal procedures by mass forces generated by an inertia based pivoting in the reversal plane.

The reversal forces required for the reversal of the blowing direction are initiated preferably via the force application to the fan wheel and, consequently, only indirectly dependent on the controllable drive power. Instead of, or if expedient, also additionally to the aerodynamic axial force application to the fan wheel and its blades, the hub may also include a separate adjustment device. Such an adjustment device may simply be a magnetically actuated device so that the reversal of the fan blades can be obtained by the adjustment device alone and/or in combination with the aerodynamic force application.

Furthermore, the number of shift windows can be selected in accordance with the form of the meander-like structure, which advantageously has at least two shift windows which are arranged opposite one another with respect to the axis of rotation and which have guide flanks designed for a low-friction axial movement of the star wheel with respect to the annular discs.

BRIEF DESCRIPTION OF THE DRAWINGS

Additional details and features of the invention will become apparent from the following description of the invention with reference to the accompanying drawings. It is shown in.

DETAILED DESCRIPTION OF PARTICULAR EMBODIMENTS

Figure 1:
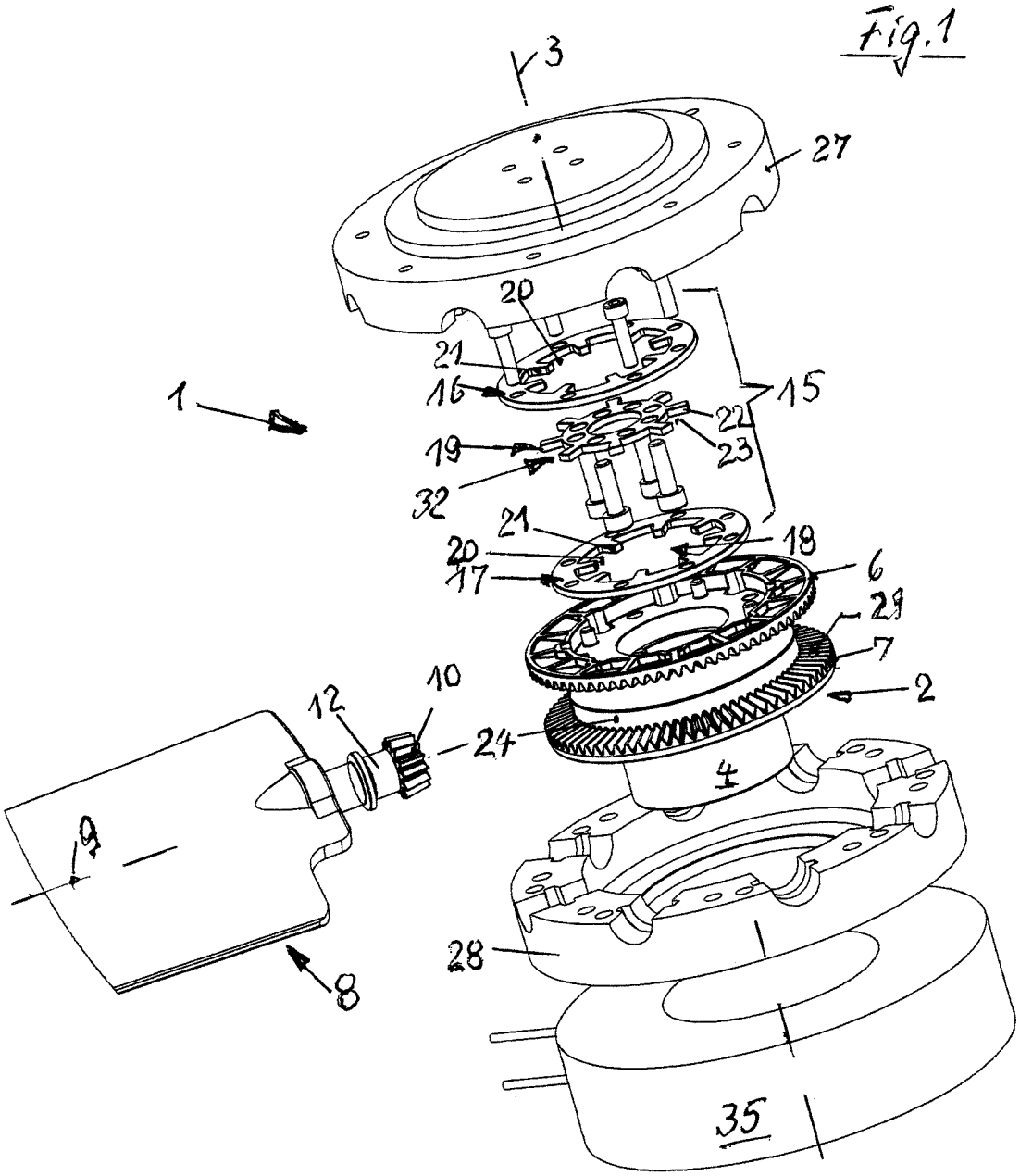
FIG. 1 an exploded representation of the hub area of the fan wheel indicating the position of a fan blade of the fan wheel relative to the hub and showing the rotational drive separated from the adjustment drive for rotating the fan blades about the fan blade axes.
Figure 2:
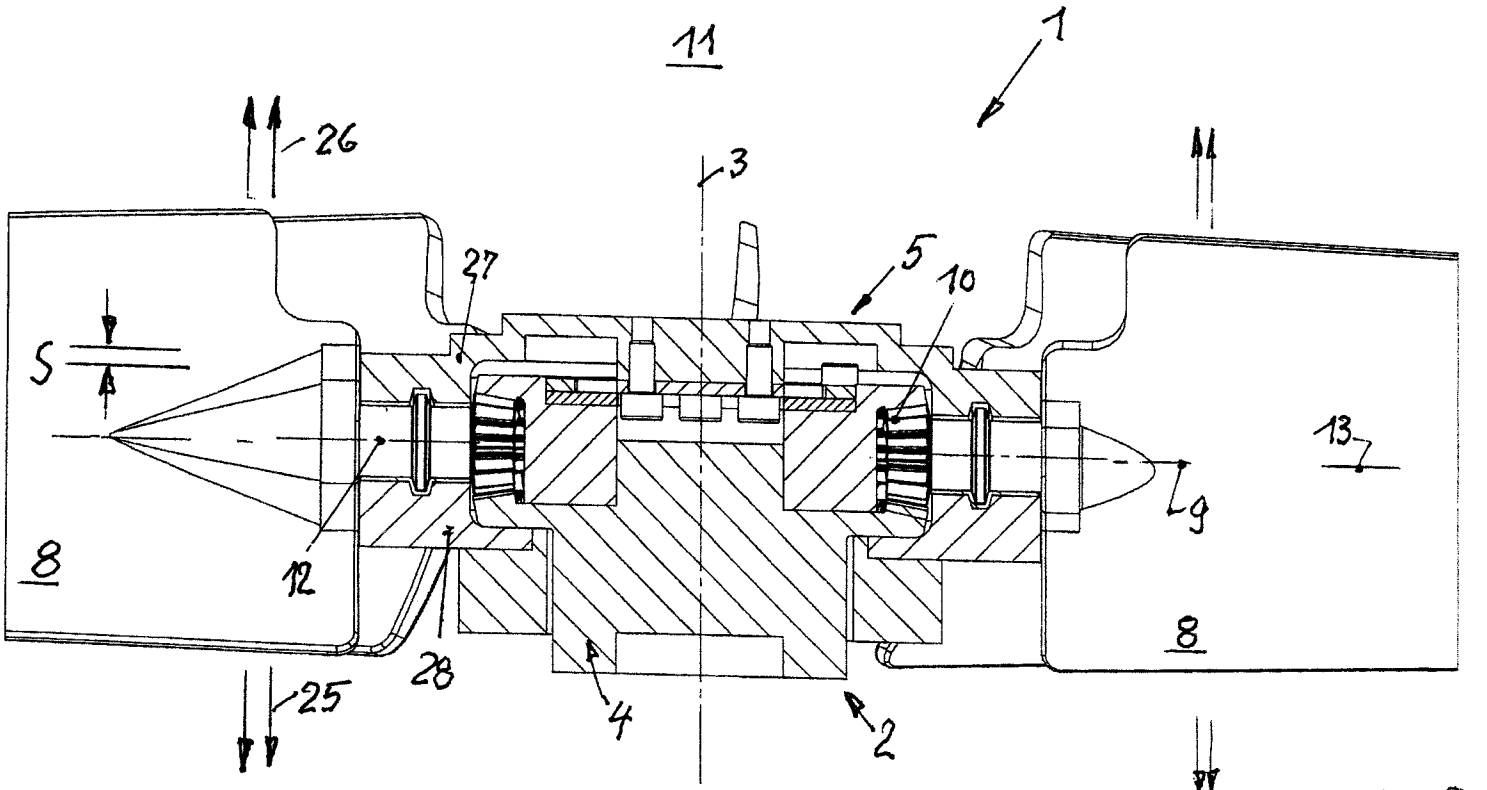
FIG. 2 a schematic cross-sectional showing of the exploded representation of the fan wheel taken along the axis of a fan blade.

The fan wheel according to FIG. 2, which is shown in FIG. 1 in a perspective exploded representation in a detailed manner, is designated overall by the numeral 1. It comprises as part of a drive unit 2 a drive part 4 which is co-axial with the axis of rotation 3 of the fan wheel. Integrated with the drive part 4 in the drive unit 2, in each case, a motorized drive may be provided, if expedient in the form of an electric motor. Or the motor may be directly or indirectly coupled to the drive part.

In both embodiments, the drive part 4 includes, co-axially in the direction of the axis of rotation 3 of the fan wheel, opposite annular drive tracks 6 and 7 which form opposite side walls of an outwardly open annular channel 24 in which the pin-like foot pieces 12 of the radial fan blades 8 of the fan wheel 1 are accommodated with radial play. Preferably, the end of the foot piece 12 extending into the annular channel 24 are formed by drive elements such as pinions 10, which during a force transmission to one of the drive tracks 6, 7 are each rotatable with the opposite drive track 7, 6 in a circumferential direction.

With this arrangement the drive part 4 is slidable in the direction of the axis of rotation 3 within the limits of the axial play S which, alternatively, facilitates engagement of the pinion 10 with one of the opposite drive tracks 6, 7.

With this engagement of the end of the pin-like foot piece 12 formed in each case by a pinion 10 between the axially spaced drive tracks 6, 7 and the respective drive support on only one of the drive tracks 6, 7, the fan blades 8 are rotatable about the blade axes 9. This rotatability of the fan blades 8 about the blade axes 9 makes a switch-over to opposite blowing directions possible while the fan wheel 1 remains rotating in the same direction. In this way a reversal between an operative mode of suctioning an air flow through a heat exchanger 11 disposed in front of the fan wheel, that is a suction position 25, and a blowing position 26, wherein the fan wheel 1 produces an air flow toward the heat exchanger 11 in order to remove deposits from the heat exchanger 11 by blowing them off the heat exchanger 11.

Figure 3:
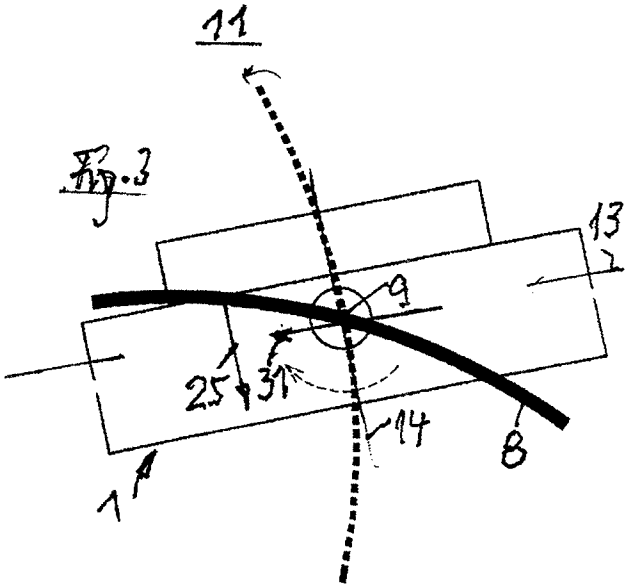
FIGS. 3 and 5 schematic representation of a fan wheel blowing in opposite directions wherein fan blades are adjusted for a reversal of the blowing direction in a reversal plane extending transverse to the rotational plane of the fan wheel, FIGS. 4 and 6, with corresponding fan blade positions according to FIGS. 3 and 5, the functioning of the intermittent operation of the control drive for rotating the fan blades about the fan blade axes and the intermittently following operating steps thereof in a development, and FIGS. 7 and 8 representations basically corresponding to FIGS. 3 and 5, wherein, different from FIGS. 3 and 5, for a reversal of the blowing direction, the fan blades are supported on the hub rotatably about the blade axes via the rotational plane of the fan wheel representing a reversal plane.
Figure 5:
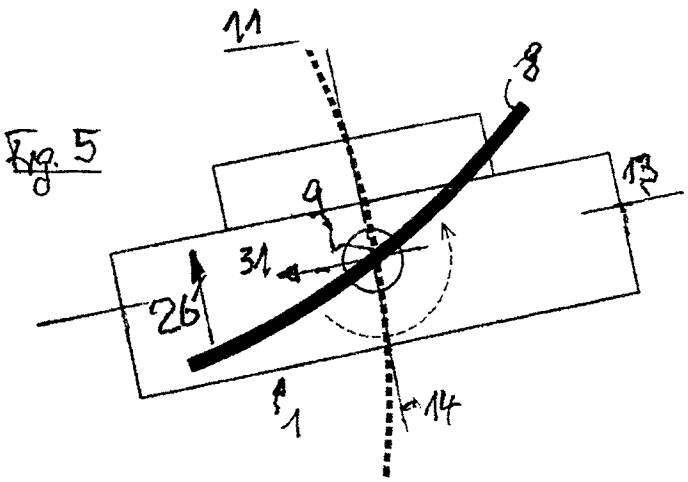

For a fan wheel 1 according to FIGS. 3 and 5, with fan blades 8 extending radially from its hub 5 and being rotatable about their blade axes 8, a reversal of the blowing direction while rotating in the same direction is made possible by a reverse rotation of the fan blades 8 in a reversal plane 14 which extends transverse to the plane of rotation 13 of the fan wheel 1. The reversal plane 14 is disposed in the transition area between the blade positions in the suction mode and in the blowing mode and corresponds to a—with respect to the blowing directions in the suction—and the blowing mode—direction-neutral transition location of the fan blades 8. The reversal via the reversal plane 14 is not associated with a change of an air flow exposure of the fan blades between the blade surfaces 33 and 34 which are disposed opposite one another with respect to the fan blade plane as it is the case in the exemplary embodiment according to FIGS. 7 and 8. The blowing conditions are therefore the same in both blowing directions.

In accordance with the—dependent on the operating mode—in the suction operation and the blowing oppositely directed blowing direction and, the resulting axial forces acting via the fan blades 8 and the support bearings thereof on the hub 5 in the direction of the axis of rotation 3, there is an axial displacement of the hub 5 relative to the drive part 4 within the play range S. As a result of this displacement, the support position of the pinion 10 on the drive tracks 6, 7 changes in connection with the rotational drive direction of the pinion 10 and, as a result, also for the respective fan blade 8.

In the exemplary embodiment, the reversal of the blade angle for a change of the blowing direction under the influence of aerodynamic and/or inertia-based adjustment forces is initiated for example by a short interruption of the drive. However, in accordance with the invention, corresponding control impulses may be applied to the hub 5 for example by mechanical or electric control devices by which a certain desired reversal of the fan wheel can be initiated as desired. Such a reversal arrangement may additionally be used for example for establishing speed-dependent and/or temperature dependent switch-over points.

With regard to the arrangement according to the invention the drive tracks 6, 7 are formed by spur gears with opposite gear rings between which the pinions 10 extends. Between the pinions 10 and the gear rings 29 there is so much clearance that between the gears of the gear rings 29 and the pinions 10 no drive connection is established with an axial load application to the hub 5 between the respective gear pairs, but the pinions 10 are still rotary position synchronized that is in that all fan blades 8 have the same angular setting.

The reversal of the fan blades 8, which are supported by the hub 5 in the separating plane between the drive-side hub part 28 and the opposite head-side hub part 27, in their orientation in opposite blowing directions, that is for "suction" or for "blowing", is shown in FIGS. 3 and 5. The blade reversal is achieved by rotating the fan blades 8 about the fan blade axes 9. The reversal to opposite blowing direction may involve a rotation of the fan blades 8 about the fan blade axes 9 over an angle of about 120 to 150 degrees. This rotation may be performed within a transverse plane which extends normal to the plane of rotation 13 of the fan wheel 1 and which is designated as reversal plane 14, as shown in FIGS. 3 and 5.

The reversal is performed in the exemplary embodiment in an adjustment mechanism 15 which is concentric with the drive part 4 and the hub 5 and surrounded by the hub 5 as shown for example in FIG. 1.

The adjustment mechanism 15 comprises two annular discs 16, 17 which are concentric with the axis of rotation 3 of the fan wheel 1 and consequently also co-axial with the hub axis and which are provided at their inner circumference delimiting a central cavity in each case with essentially congruent, about meander-shaped, inner contours 18. With regard to the meander-shaped inner contour 18 the annular discs 16, 17 are displaced circumferentially with respect to each other but axially solidly interconnected. Fitted to the inner contour structure 18 of the annular discs 16, 17 a star wheel switch 19 is provided with a circumferential complementing meander-shaped outer contour 32.

The respective meander-shaped outer contour 18 or respectively 32 is obtained in that the annular discs 16, 17 have cut-outs 20 which are open toward the inner circumference and which are delimited from each other by arms 21 extending radially into the cut-outs 20. The complementary outer structure 32 of the star wheel switch 19 is provided with arms 22 which project toward the outer circumference thereof providing for intermediate cut-outs 23 wherein the distance in circumferential direction between radially projecting adjacent arms 21 of the annular discs 16, 17 and, accordingly, the circumferential width of the cut-outs 20 of the annular discs 16, 17 is greater than the width of the arms 22 of the star wheel switch 19.

Accordingly the star wheel switch 19 has, with respect to a particular arm 22 in a particular cut-out 20 forming a switch window 30 of one of the annular discs 16, 17, a certain play in the circumferential direction so that a switch window 30 is formed. A smooth sliding of the arms 22 of the star wheel switch 19 into corresponding cut-outs can be facilitated by rounding and/or chamfering the edges.

The star wheel switch 19 support is stable with respect to the co-axial hub 5 on an axial interface location with respect to the annular discs 16, 17. In accordance with the axial pressure on the hub 5 by axial forces in opposite directions during operation in the suction or the blowing operation 26, the star wheel switch 19 abuts in each case one of the annular discs 16, 17 in the same plane whereby the annular discs 16, 17 which in their stable, combined state form a packet which, in spite of the small thickness of the discs 16, 17, can transmit large torques to the star wheel switch 19 while maintaining their shape.

The star wheel switch 19 whose thickness is adapted, at least in its outer contour, to the thickness of the annular discs 16, 17 can be reinforced at least in its center area by increasing its thickness or similar and/or by a bowl-like curvature. This is in particular possible also with regard to the rigid connection of the star wheel switch 19 to the hub head 27.

Figure 4:
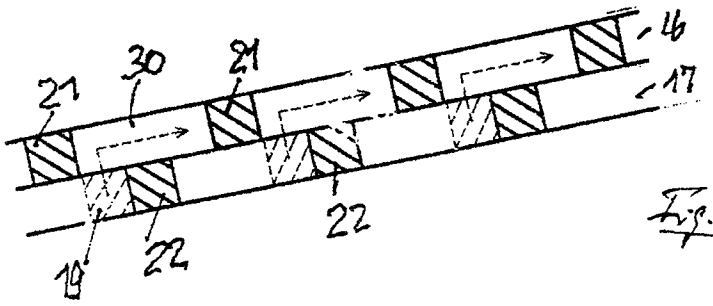
Figure 6:
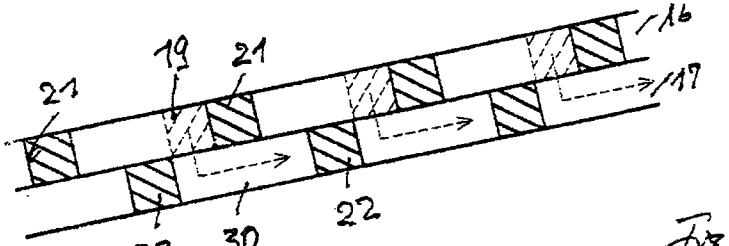

When the direction of the reaction force 29 changes depending on the position of the star wheel switch 19, the star wheel switch 19 is axially displaced in accordance with the axial play S between the hub 5 and the drive part 4, and the star wheel switch 19 in the area of the switch window 30 (see FIGS. 4 and 6) moves to the in each case other of the adjacent interconnected annular discs 16, 17. As a result of the now higher or lower location of the star wheel switch 19, the pinion 10 which is engaged between the drive tracks 6 and 7 changes its engagement position with respect to the drive tracks 6, 7. This again results in a change of the rotational direction and the rotational position of the fan blades 8 about their blade axes 9 and a reversal of the blowing direction while rotational direction of the drive remains the same.

When for example, starting with the operating mode "blowing", a reversal to the operating mode "suction" occurs, the axial pressure application on the fan wheel effective with the blowing state is reduced as the orientation of the fan blades 8 comes closer to the reversal plane 14 and, in an interface area, leads to a reversal of the axial force application to the fan wheel and to a switch-over of the abutment of the pinion 10 between the drive tracks 6 and 7. This results in the reversal of the fan blades 8 which occurs in the area of the switch windows 30.

In accordance with the structuring of the annular discs 16, 17 and the star wheel switch 19 over the respective circumference, in each case at least one switch window 30 is provided, but with regard to symmetric support forces with respect to the axis of rotation 3 at least two or more diametrically opposite switch windows are provided.

In addition to securing the axial position of the star wheel switch 19, which is supported on the hub 5 for rotation therewith, but axially movable within limits provided by the play S in each case in accordance with the operating mode "blowing" or "suction" with axially overlapping annular discs 16, 17 outside the switch window—limited reversal area the invention provides for an expansion of the functions and a very compact design. Furthermore, the rotational play between the star wheel switch 19 and the annular disc 16, 17 which is in an axial overlap position provides for a low-shock transition during the change-over of the star wheel switch 19 between the annular discs 16, 17 because of the corresponding speeds and the, in each case play-limited step-like interrupted drive connection.

The separation of the axial and radial engagement path in the drive connection between the drive part 4 and the hub 5 which is subjected by the aerodynamic force as provided by the invention is advantageous with regard to the design possibilities, in particular with regard to the design of the adjustment mechanism 15 which can be provided by elements which are easy to manufacture and cooperating in a space-saving manner and which provide for a light-weight and compact design by a mutual support of the elements.

The adjustment mechanism 15 according to the invention provides, apart from the reversal mode, for the result that the fan blades 8 are via the respective pinions 10 always in engagement with one of drive tracks 6, 7 and, in this way, the fan wheel 1 is supported rotationally parallel to the drive part 4 by drive paths which extend parallel to the drive part 4 that is by the mentioned engagements of the pinion 10 with one of the drive tracks 6, 7 and via the support of its fan blades 8 in the hub 5 which is connected to the drive part 4 for rotation with the hub 5. This results in a mutual load reduction.

In a fan wheel 1 which is driven in only one rotational direction with a central drive unit 2, with a hub 5 which extends co-axially with the drive unit 2 and with fan blades 8 which are supported in the hub 5, the fan blades 8 are accommodated at their base ends between two co-axial opposite drive tracks 6, 7 which are associated with the drive unit 2. The fan wheel has fan blades whose angles are adjustable by driving the fan via, in each case, one of the drive tracks 6, 7 thereby rotating the blades about the blade axis in a reversal plane 14 which extends normal to the plane of rotation 13 of the fan for blowing in opposite directions. The reversal plane 14 extends normal to the plane of rotation 13 or, as shown in FIGS. 7 and 8, the reversal plane 14 is congruent with the plane of rotation 13.

Figure 7:
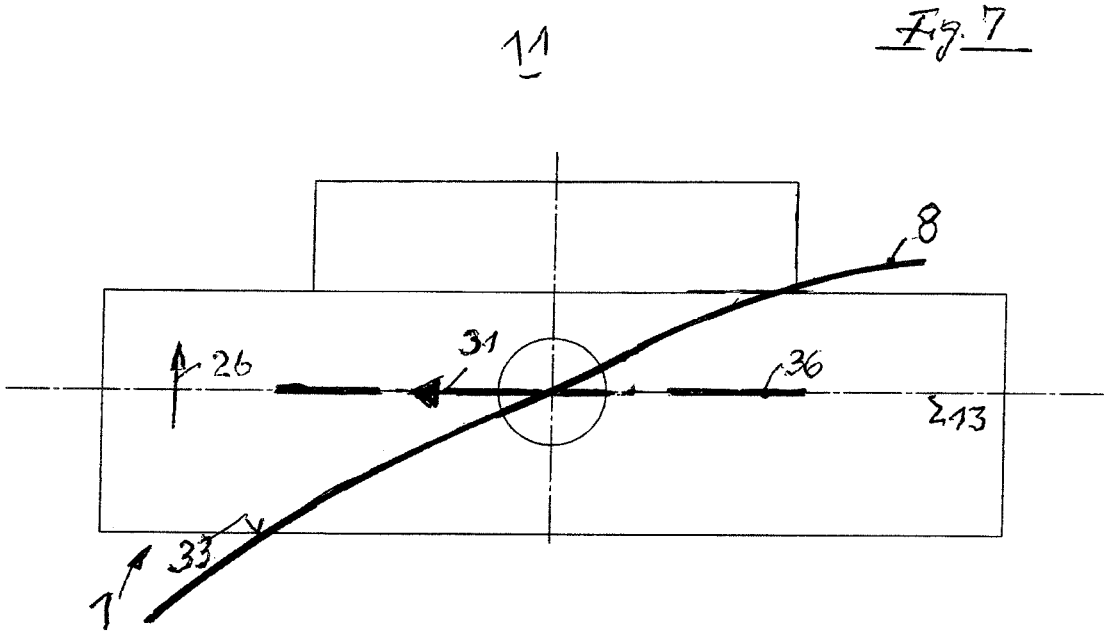
Figure 8:
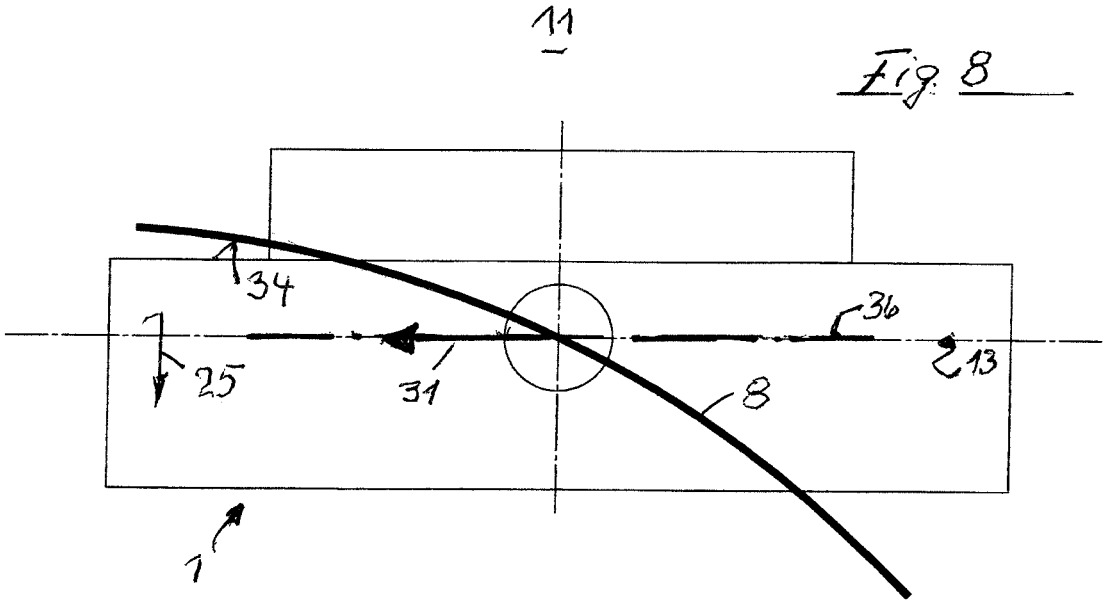

With regard to the exemplary embodiment of FIGS. 7 and 8 the direction of rotation of the driven fan wheel 1 is indicated by arrow 31. With respect to the direction of rotation 31 and, consequently, also the plane of rotation 13 of the fan wheel, the fan blades 8 are set at an angle—depending on the desired blowing direction—with regard to FIG. 7 in a position 26 for a blowing operation and in FIG. 5 and FIG. 8 in a position for a suction operation 25 according to FIG. 3. The reversal between suction and blowing operation occurs in a—with regard to the blowing direction—neutral reversal plane 36 which coincides with the plane of rotation 13. Otherwise operating conditions are provided which are comparable to those of FIGS. 3 and 5, and also according to FIGS. 4 and 6, so that with an in principle identical design an adaptation to respective requirements is possible, in particular because of the solutions according to FIGS. 7 and 8 which show blade surfaces 33, 34 that are differently, that is oppositely, curved for suction and blowing operations for obtaining differences with respect to operating in the suction and blowing operations.

The, with respect to the blowing direction, neutral reversal position 36 of the fan blades 8 can in accordance with the invention also be used as a holding intermediate position for interrupting and switching off the air supply in spite of a continuing running of the drive and the fan wheel. To this end the intermediate position can be adjusted and maintained by the positioning mechanism 35, in particular in the form of a magnetic controller, independently of the other control forces applied to fan wheel 1.

LISTING OF REFERENCE NUMERALS

1 fan wheel
2 drive unit
3 axis of rotation
4 drive part
5 hub
6 drive track
7 drive track
8 fan blade
9 fan blade axis
10 pinion
11 heat exchanger
12 foot pieces of fan blades
13 plane of rotation of fan wheel
14 reversal plane
15 adjustment mechanism
16 annular disc
17 annular disc
18 inner contour
19 star wheel switch
20 cut out
21 arm
22 arm
23 cut-out
25 suction position
26 blowing position
27 hub part
28 hub part
29 reaction force
30 switch window, shift window
31 direction of rotation of fan wheel
32 outer contour
33 blade surface
34 blade surface
35 positioning mechanism
36 neutral reversing plane
S axial play

What is claimed is:

1. A fan wheel (1) to be driven in only one direction of rotation (31), the fan wheel (1) comprising:

a hub (5) co-axial with a drive unit (2);

radial fan blades (8) which are supported in the hub (5), the radial fan blades (8) are engaged at their base with radial play between two stable drive tracks (6, 7) arranged co-axially opposite each other in the direction of the axis of rotation (3) of the fan wheel (1), the radial fan blades (8) have blade angles that are adjustable about the blade axis by driving the fan wheel (1) in each case via one of the two stable drive tracks (6 respectively 7) in a reversal plane (14) extending normal to a plane of rotation (13) of the fan wheel (1) for blowing in opposite directions; and, wherein the hub (5) is axially movable by a respective axial load application relative to the drive unit (2) and, correspondingly, to an axial displacement of the hub (5), the rotational position of the radial fan blades (8) is adjustable in the area of a switch window (30) overlaying the reversal plane (14) for blowing in said opposite directions.

2. A fan wheel (1) to be driven in only one direction of rotation (31), the fan wheel (1) comprising:

a central drive unit (2) with a hub (5), the hub (5) is co-axial with the central drive unit (2);

fan blades (8) which are supported by the hub (5), the fan blades (8) are engaged at their base between two stable drive tracks (6, 7) with regard to the central drive unit (2), the two stable drive tracks (6, 7) arranged co-axially opposite each other, the fan blades (8) have blade angles that are reversible for blowing in opposite blowing directions via, by being driven, in each case, by one of the two stable drive tracks (6, 7) thereby rotating the fan blades (8) about their blade axes (9) in a reversal plane (14) which extends along a plane of rotation (13) of the fan wheel (1); and, wherein the hub (5) is axially movable by an axial force application to the central drive unit (2) and, corresponding to an axial displacement of the hub (5), the angular position of the fan blades (8) is reversable between said opposite blowing directions in the area of a switch window (30) overlaying the reversal plane (14).

3. The fan wheel (1) to be driven in only said one direction of rotation (31) according to claim 1, wherein the size of the switch window (30) extending over a section of rotation of the fan wheel (1) is determined by an adjustment mechanism (15) which is disposed in a drive connection between the drive unit (2) and an end of the hub (5) opposite the drive unit (2).

4. The fan wheel (1) to be driven in only said one direction of rotation (31) according to claim 3, wherein the adjustment mechanism (15) includes coaxially firmly interconnected concentric annular discs (16, 17) with identical non-round inner diameters, the concentric annular discs (16, 17) are rotationally displaced and have cut-outs (20) which are open toward their inner diameter for accommodating radial arms (22) of a centrally arranged star wheel switch (19) whose axial position relative to the concentric annular discs (16, 17) is adjustable to be in the same planes as the concentric annular discs (16, 17).

5. The fan wheel (1) to be driven in only said one direction of rotation (31) according to claim 4, wherein a reversal of the radial fan blades (8) between their suction position (25) and their blowing position (26) corresponds to an axial displacement of the star wheel switch (19) between the concentric annular discs (16, 17).

6. The fan wheel (1) to be driven in only said one direction of rotation (31) according to claim 1, wherein the hub (5) is axially displaceable relative to the drive unit (2) by an aerodynamic force application and/or by a positioning mechanism (35).

7. The fan wheel (1) to be driven in only said one direction of rotation (31) according to claim 2, wherein the size of the switch window (30) extending over a section of rotation of the fan wheel (1) is determined by an adjustment mechanism (15) which is disposed in a drive connection between the central drive unit (2) and an end of the hub (5) opposite the central drive unit (2).

8. The fan wheel (1) to be driven in only said one direction of rotation (31) according to claim 7, wherein the adjustment mechanism (15) includes coaxially firmly interconnected concentric annular discs (16, 17) with identical non-round inner diameters, the concentric annular disks (16, 17) are rotationally displaced and have cut-outs (20) which are open toward their inner diameter for accommodating radial arms (22) of a centrally arranged star wheel switch (19) whose axial position relative to the concentric annular discs (16, 17) is adjustable to be in the same planes as the concentric annular discs (16, 17).

9. The fan wheel (1) to be driven in only said one direction of rotation (31) according to claim 8, wherein a reversal of the fan blades (8) between their suction position (25) and their blowing position (26) corresponds to an axial displacement of the star wheel switch (19) between the concentric annular discs (16, 17).

10. The fan wheel (1) to be driven in only said one direction of rotation (31) according to claim 2, wherein the hub (5) is axially displaceable relative to the central drive unit (2) by an aerodynamic force application and/or by a positioning mechanism (35).

* * * * *